US005490392A

United States Patent [19]

Williams et al.

[11] Patent Number: 5,490,392

[45] Date of Patent: Feb. 13, 1996

[54] HEAT TRANSFER METHOD AND APPARATUS

[75] Inventors: Roger D. Williams, Dallas; Mark S. Gengler, Shelby, both of N.C.

[73] Assignee: Pneumafil Corporation, Charlotte, N.C.

[21] Appl. No.: 332,355

[22] Filed: Oct. 31, 1994

[51] Int. Cl.[6] ..... F28G 13/00

[52] U.S. Cl. ..... 62/91; 62/307; 62/314; 62/303; 165/95; 261/153

[58] Field of Search ..... 62/303, 304, 306, 62/307, 310, 314, 69, 70, 91; 165/95, 109.1; 261/124, 153

[56] References Cited

U.S. PATENT DOCUMENTS

| | | | |
|---|---|---|---|
| 1,894,441 | 1/1933 | Copp | 62/303 X |
| 2,643,523 | 6/1953 | Burgess | 62/304 X |
| 2,743,091 | 4/1956 | Day et al. | 62/304 X |
| 3,216,181 | 11/1965 | Carpenter et al. | 261/124 X |
| 4,857,090 | 8/1989 | Hartness | 62/91 |

*Primary Examiner*—William E. Tapolcai
*Attorney, Agent, or Firm*—Shefte, Pinckney & Sawyer

[57] ABSTRACT

The present invention relates to an improved heat transfer device, such as the heat exchanger included in a system for cooling and conditioning air in a textile mill, the system having an air washer and the heat exchanger operating to cool water to be used in the air washer. Water is circulated through a chilling basin where it is cooled by a refrigeration system having evaporator panels in the basin, and the water flows through the basin from a supply inlet to a discharge outlet. Bubbler tubes discharge streams of air bubbles so that the air bubbles flow along the evaporator panels in close proximity thereto. Preferably, the streams of air bubbles are discharged from the bubbler tubes under pressure supplied by an air blower, with a manifold and connecting pipes supplying the pressurized air to the bubbler tubes. The bubbler tubes are preferably spaced from the outlet so that air bubbles do not enter the discharge outlet. The chilling basin is preferably located adjacent the air washer, and both are preferably contained in a single housing.

19 Claims, 4 Drawing Sheets

HEAT TRANSFER METHOD AND APPARATUS

BACKGROUND OF THE INVENTION

The present invention relates generally to heat exchangers and, more particularly, to systems for cooling and conditioning air such as in textile mills and similar environments as described in U.S. Pat. No. 4,857,090.

U.S. Pat. No. 4,857,090 sets forth a system that is capable of cooling and conditioning air which has significantly elevated humidity and/or air temperature. This type of system is particularly advantageous for application in textile spinning operations, which frequently employ open-end spinning machines that include rotors which pull in a significant quantity of room air as part of the spinning process, and then exhaust this air back into the room at markedly elevated temperatures. In some typical open-end spinning machines, each rotor pulls in approximately 12 CFM to 13 CFM of air and heats this air approximately 48° F. An open-end spinning machine of this type having 216 rotors will thus exhaust approximately 2700 CFM of air heated to a temperature of approximately 124° F. back into the room where the spinning machines are located.

This heated air generated by open-end spinning rotors can create significant problems in a spinning mill because precise temperature and humidity conditions are required in order to maintain the quality of the yarn formed by the open-end spinning process within acceptable limits. Room temperature is usually maintained within the range of 74° F. to 80° F. and relative humidity within the range of 58% to 62%. While cooling and conditioning systems of the type in U.S. Pat. No. 4,857,090 have proven to efficiently operate under demands such as those found in modern open-end spinning mill applications, the power consumption of these systems may be substantial.

Furthermore, heat exchangers that are employed to cool the water used in the air washers of systems of this type must periodically be cleaned, because foreign matter tends to collect and adhere on the interior surfaces of the heat exchangers, thereby substantially reducing the efficiency of heat transfer between the heat exchanger and the water being cooled. Difficult and time consuming mechanical cleaning is often necessary in order to restore the heat exchanger to its original operating efficiency, and therefore the operating cost of the system may be significantly increased by the expense associated with such cleaning. For systems with closed vessel heat exchangers, the cooling and conditioning system must usually be shut down in order to accomplish cleaning of the heat exchanger, potentially resulting in reduced operating time for the spinning mill itself. Automatic cleaning systems for closed vessel heat exchangers have not proven to be capable of adequately operating in textile mill applications because of the unique nature of textile fibers, which collect in the reservoir of the air washer and then flow into the heat exchanger, where they foul the brushes used in automatic cleaning systems. Cooling systems employing open vessel heat exchangers, which may be more easily cleaned, have not previously been capable of attaining the cooling capacity necessary in modern industrial applications.

In typical installations, the heat exchanger is located centrally and serves a plurality of air washers located at some distance from the heat exchanger. This arrangement requires a significant amount of piping to transport water between the heat exchanger and air washers and creates inefficiencies which reduce the system's cooling capacity. Additionally, the use of a central heat exchanger results in all of such air washers receiving water chilled to substantially the same temperature, although it may be advantageous to provide water at different temperatures to different air washers.

In accordance with the present invention, a heat transfer device, such as may be used in a heat exchanger for cooling water, is provided in which heat transfer efficiency is improved and cleaning requirements are significantly reduced, thereby reducing energy consumption, operating costs, and potential down-time.

SUMMARY OF THE INVENTION

Briefly summarized, the present invention provides a heat transfer device for altering the temperature of a liquid whereby the heat transfer between a heat transfer surface and the liquid is improved, and the accumulation of foreign matter on the heat transfer surface is reduced. According to the method and apparatus of the present invention, the liquid is circulated so that it flows over a heat transfer surface, and the heat transfer surface is maintained at a temperature different from the temperature of the liquid so that heat will be transferred between the heat transfer surface and the liquid. A gas (e.g., air) is discharged in the liquid so that a stream of bubbles is formed, and the gas discharge is located so that the stream of bubbles flows along the heat transfer surface in close proximity thereto. It is advantageous for the temperature of the heat transfer surface to be maintained at the desired level by circulating a heat exchange fluid (e.g., a suitable refrigerant circulating within a refrigeration system) in relation to the heat transfer surface, such heat exchange fluid having a temperature that is capable of maintaining the heat transfer surface at the appropriate level.

It is also advantageous if the gas which is discharged to form the stream of bubbles is discharged through a bubbler device, which preferably includes a gas blower, a manifold into which the gas blower introduces gas at a positive pressure, and connecting pipes which carry the gas to the bubbler device.

In the preferred embodiment of the present invention, the liquid is circulated into a liquid supply inlet, then over the heat transfer surface, and then out through a liquid discharge outlet, and the bubbler device immediately upstream from the water discharge can be spaced a sufficient distance away from the outlet to prevent air bubbles from entering the water discharge outlet.

In accordance with another aspect of the invention, the method and apparatus of the present invention may be used together with a system for cooling and conditioning air by moving air along a flow path into a cooling stage in which chilled water is sprayed into the air to reduce the temperature of the air. The water may be chilled by circulating it over the aforesaid heat transfer surface, which is maintained at a temperature less than the temperature of the water by circulating a heat exchange fluid in communication with the heat transfer surface.

The heat transfer surface may advantageously comprise a plurality of heat transfer panels, each panel having two substantially planar exterior surfaces, with the panels being immersed in the water to be chilled and positioned substantially vertically and in substantially parallel relation to each other, and the bubbler device may comprise a plurality of bubbler tubes arranged in substantially parallel relation to the heat transfer panels, with each of the heat transfer panels being located an equal distance from each of the closest pair of bubbler tubes, whereby at least some of the streams of air bubbles from one bubbler tube pass along the adjacent planar exterior surfaces of two heat transfer panels.

Barrier walls may be arranged to cause the water to flow around the heat transfer panels in a serpentine path extending between the inlet and outlet.

The cooling stage and the basin in which the heat transfer panels are located may be disposed adjacent one another in a single housing, and the air flow path may pass over the basin in which the heat transfer panels are located.

Accordingly, the present invention provides a highly efficient and self-cleaning system for heat transfer, which reduces significantly the costs and potential down-time associated with conventional heat transfer systems.

DETAILED DESCRIPTION OF THE PREFERRED EMBODIMENT

Figure 1:
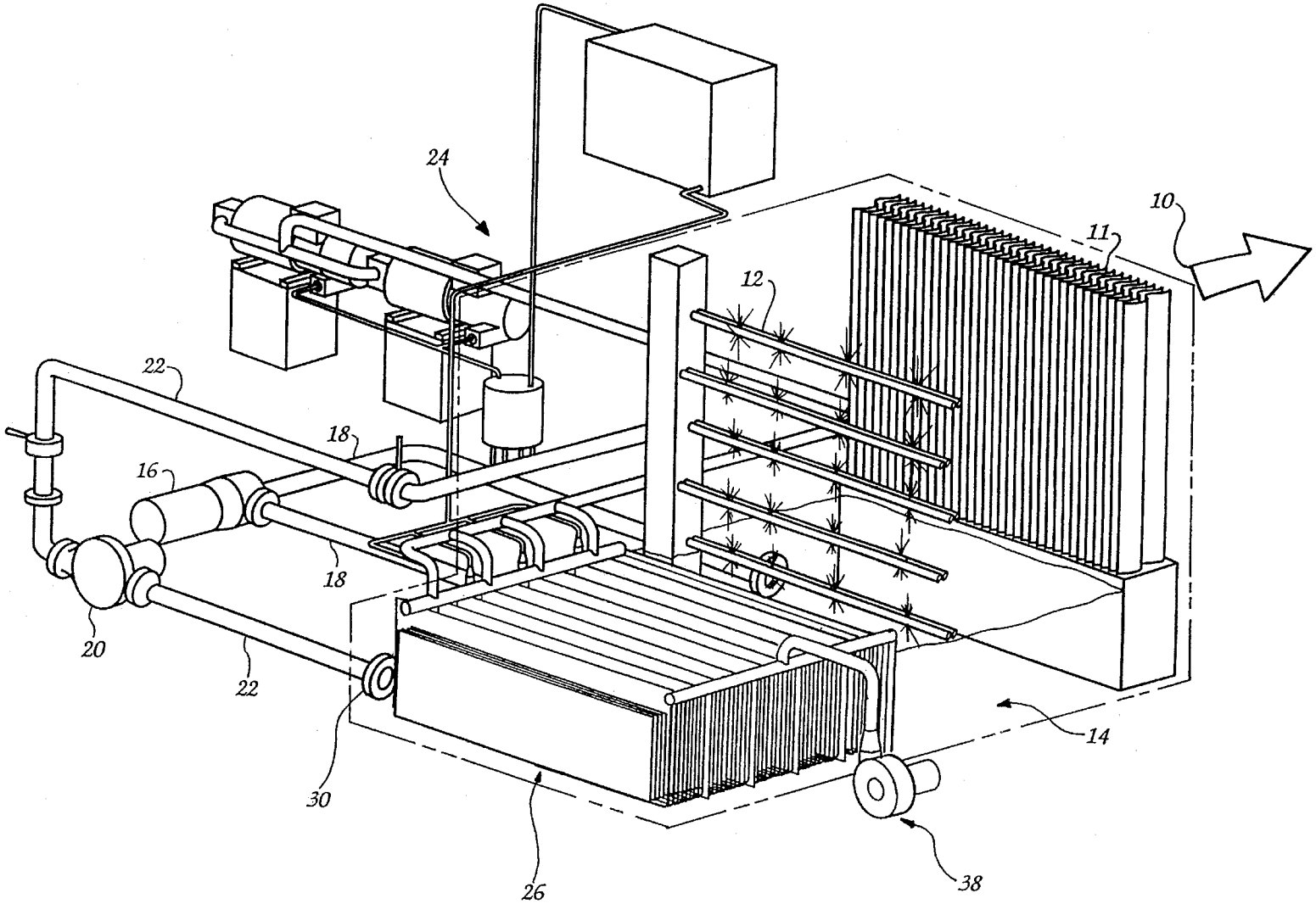
FIG. 1 is a perspective view of a cooling and conditioning system embodying the present invention.

Looking now in greater detail at the accompanying drawings, and initially focusing on the construction of a cooling and conditioning system embodying the present invention, FIG. 1 illustrates in diagrammatic form the arrangement of components constituting such system. Air which is to be conditioned by the system, such as air with elevated temperature and humidity levels discharged from the above-described open-end spinning machines, is directed along a flow path as indicated by air flow arrow 10, in which is located an air washer comprising conventional spray pipes 12 and a collecting reservoir 14, it being understood that spray pipes 12 could constitute a larger or smaller bank of pipes, depending on the design parameters of the cooling and conditioning system. Water is sprayed into the air flow from spray pipes 12, thereby cooling the air to be conditioned, and is then collected in a reservoir 14, from which a pump 16 then causes the water to flow through conduit 18 to a water supply inlet 28 (see FIG. 2) of a chilling basin 26. Air leaving the air washer flows through conventional moisture eliminating baffles 11 which serve to mechanically capture large droplets of water entrained in the air flow through the air washer. A refrigerating unit 24, which extends into chilling basin 26 and chills the water in chilling basin 26, is composed of conventional refrigeration equipment employing a refrigerant medium having a low boiling point.

Figure 2:
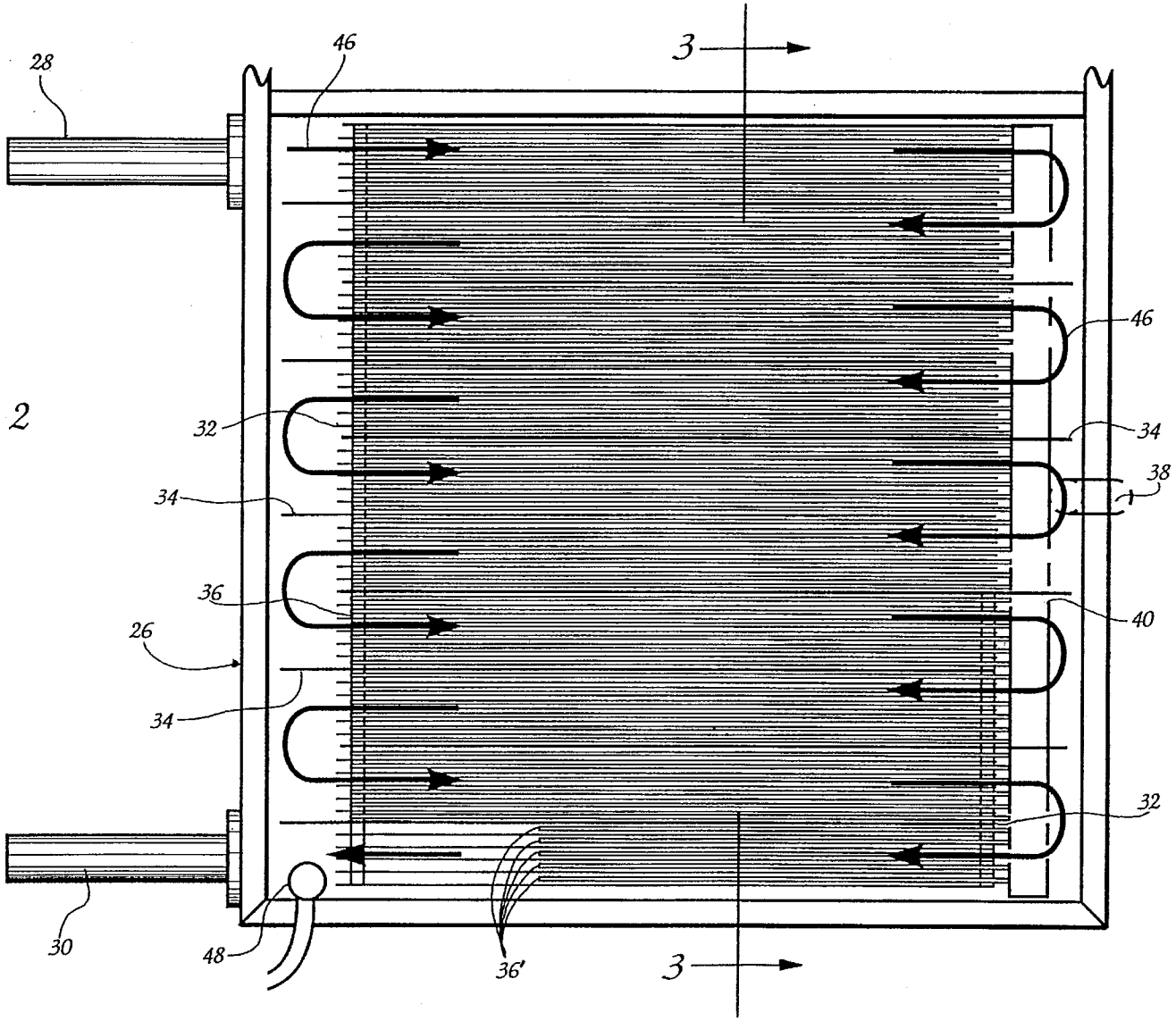
FIG. 2 is a plan view of the chilling basin of the present invention.

As best seen in FIG. 2, evaporator panels 32, which form part of the above-mentioned refrigerating unit 24 (see FIG. 1), are disposed in chilling basin 26 in the direction of water flow from the water supply inlet 28 to a water discharge outlet 30, as shown by water flow arrows 46. The evaporator panels 32 operate to chill the water by conventional methods in establishing a heat transfer relationship between their exterior surfaces and the water, and barriers 34 are situated in chilling basin 26 to direct the water so that it flows around and across the panels 32 in a serpentine flow pattern as illustrated in FIG. 2.

Looking again at FIG. 1, water leaving chilling basin 26 is caused to flow out of water discharge outlet 30 and into recirculating conduit 22 by a recirculation pump 20, which ultimately brings the chilled water back to spray pipes 12 of the air washer, from where it is again sprayed into the heated air flowing along the path shown by air flow arrows 10.

As shown in FIG. 1, chilling basin 26 and collecting reservoir 14 are disposed in a single housing, and the chilling basin 26 is located immediately adjacent the collecting reservoir 14, thereby minimizing the piping required to connect chilling basin 26 and reservoir 14 so as to create the required circulation of water described previously. Chilling basin 26 is in the path of air flowing through the housing as shown by air flow arrow 10 in FIG. 1.

Figure 3:
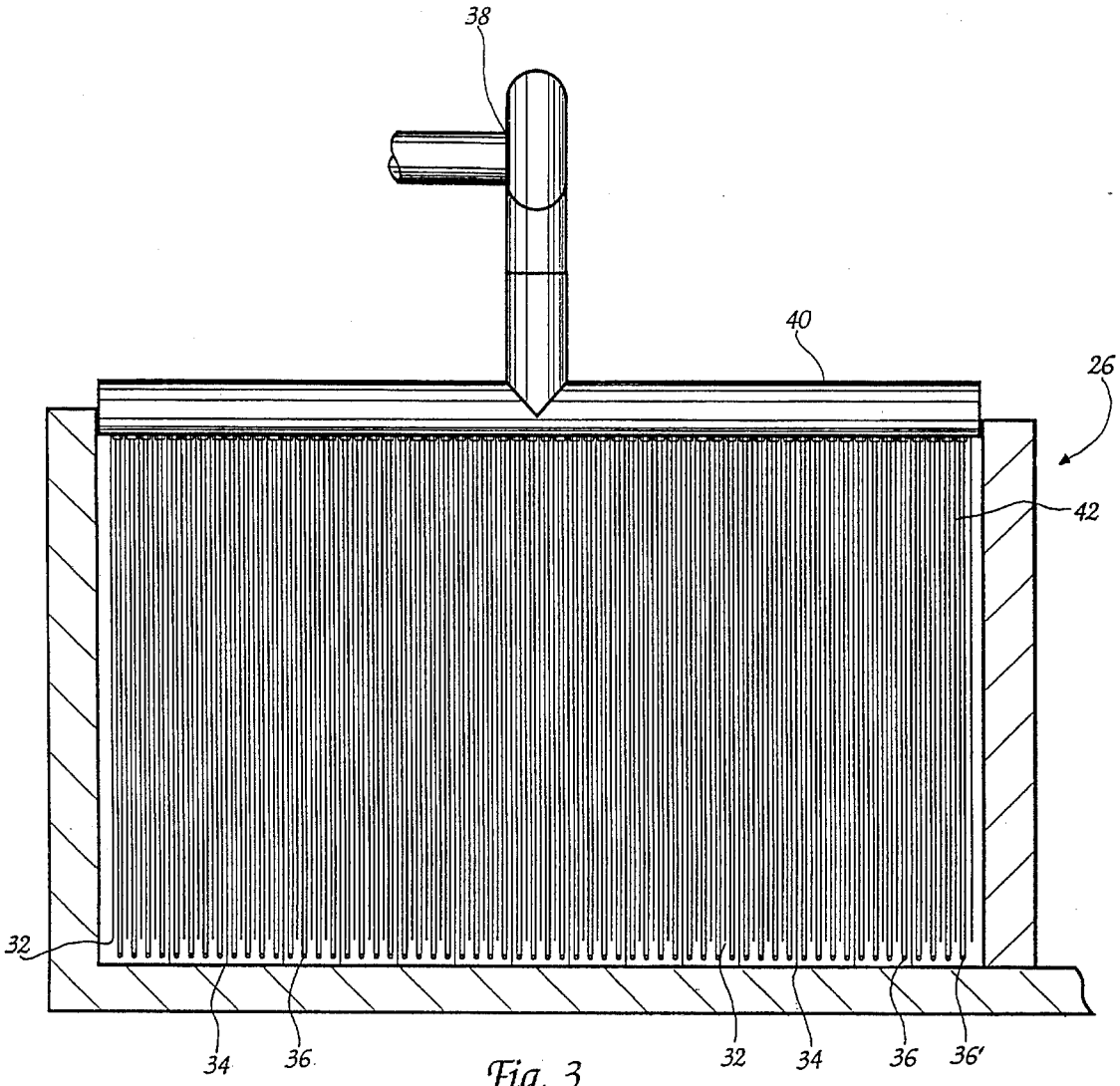
FIG. 3 is a sectional view of the chilling basin taken along lines 3—3 in FIG. 2.

In accordance with the present invention and as indicated in FIGS. 2 and 3, bubbler tubes 36,36' are located in chilling basin 26 to extend in substantially parallel relation to evaporator panels 32. An air blower and motor assembly 38 is mounted so that it communicates with a manifold 40, which feeds into connecting pipes 42, which in turn communicate with the bubbler tubes 36,36'. The particular bubbler tubes 36' which are located immediately upstream from discharge outlet 30 are spaced away from outlet 30, and a generally conventional dirt pick-up tube 48, through which suction can be applied to draw foreign matter out of the water, is located adjacent to and upstream of outlet 30.

Figure 4:
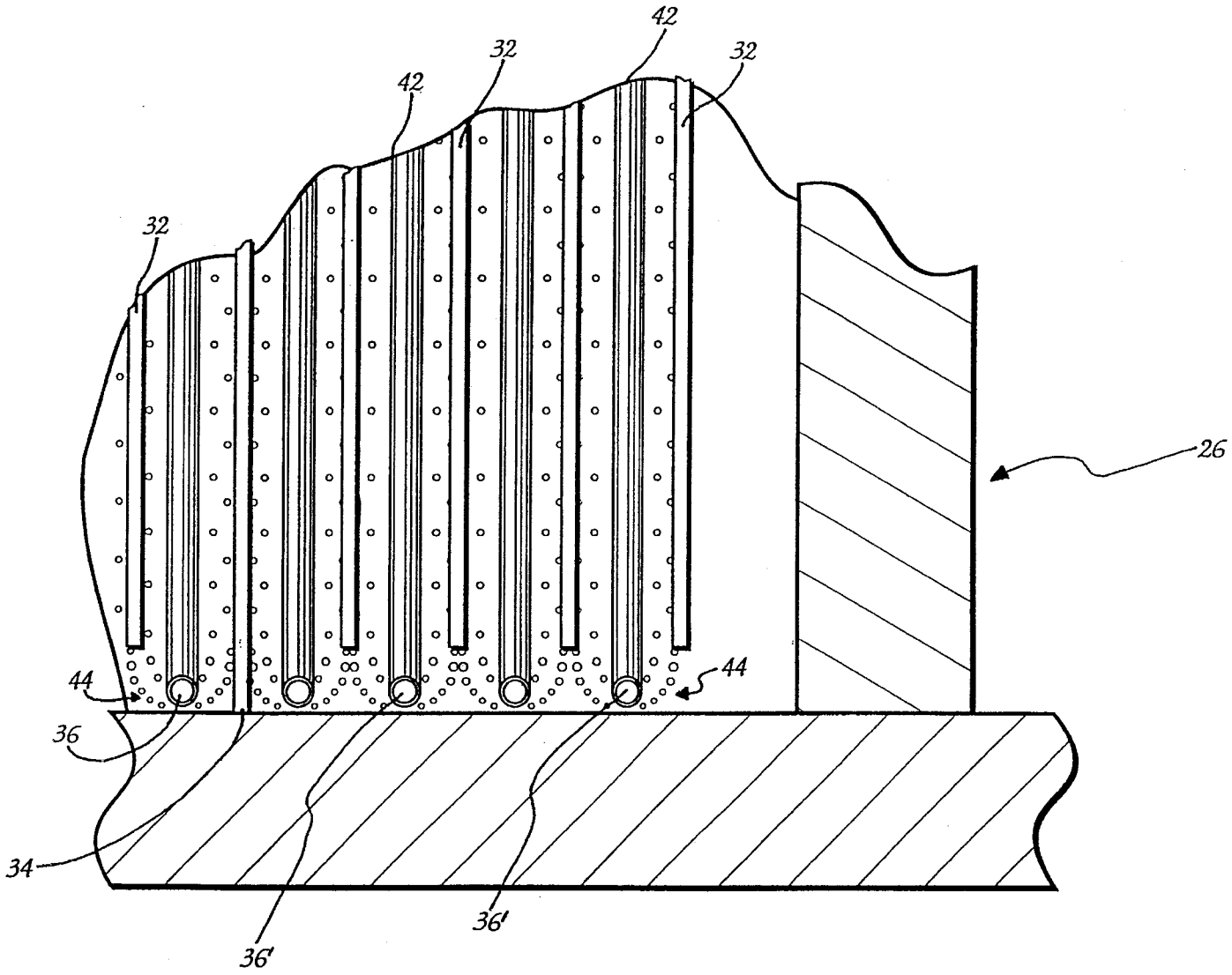
FIG. 4 is a detailed view of a portion of FIG. 3 showing the bubbler tubes.

In operation, as water flows through the chilling basin 26, air blower 38 introduces air under positive pressure into the manifold 40, from which the pressurized air flows into connecting pipes 42 and thence into bubbler tubes 36,36'. As illustrated in FIG. 4, the pressurized air is discharged from the bubbler tubes 36,36' in the form of streams of air bubbles 44, which rise through the water in the chilling basin 26. The bubbler tubes 36,36' are positioned relative to the heat transfer surface of the panels 32 to cause the streams of air bubbles 44 to be directed along a flow path that moves the bubbles along the heat transfer surfaces and generally in contact therewith. As the streams of air bubbles 44 rise and travel along the exterior surfaces of evaporator panels 32, they create turbulence and cause the water film that is in contact with the heat transfer surfaces of the evaporator panels 32 to continuously change. Preferably, each of the evaporator panels 32 are located an equal distance from each of the adjacent bubbler tubes 36, as best seen in FIG. 4, with each evaporator panel 32 between two bubbler tubes 36.

The streams of air bubbles 44 also tend to keep foreign matter in the water in chilling basin 26 in suspension and flowing toward water discharge outlet 30, and this foreign matter will be collected in an area adjacent to the discharge outlet 30 (see FIG. 2) where the dirt pick-up tube 48, located as described above adjacent to and upstream of outlet 30, operates to remove this foreign matter before the water leaves the chilling basin 26. Bubbler tubes 36' are spaced away from outlet 30 so as to prevent streams of water bubbles 44 from entering outlet 30 as the water flows out of the chilling basin 26.

Water flowing into chilling basin 26 from collecting reservoir 14, and then from chilling basin 26 to spray pipes 12, travels through a minimum amount of piping due to the location of chilling basin 26 adjacent reservoir 14.

The unique cooling and conditioning system of the present invention has several advantages over conventional systems. As noted, bubbler tubes 36,36' discharge streams of air bubbles 44 which travel along evaporator panels 32 and thereby continuously change the water film in contact with evaporator panels 32. The heat transfer process by which the water in chilling basin 26 is chilled is significantly improved by the actions of streams of air bubbles 44. The continuous change of the water film in contact with evaporator panels 32 allows heat to be directly transferred from a continuously varying water film, rather than from a relatively static water film. Heat transfer efficiency is thus significantly improved. This improvement in efficiency can result in substantial reductions in the overall size of industrial cooling and conditioning systems, which reduces the floor space required to support such systems, as well as reducing the energy consumption of such systems. Thus, capital expenditures and operating costs may both be reduced.

Furthermore, the action of streams of air bubbles 44 in the present invention keeps foreign matter, such as dust and fiber particles, in suspension in the water in chilling basin 26 and deters foreign matter from adhering to evaporator panels 32. A self-cleaning effect therefore arises from the present invention, which has important advantages for cooling and conditioning systems of this type. In conventional systems, mechanical cleaning of the surfaces of water-chilling evaporators must be undertaken at significant cost and with the potential for causing down time for an industrial facility. The present invention represents a significant advance which minimizes the necessity for such mechanical cleaning. A substantial reduction in expenses associated with the cleaning of water-chilling evaporators is thus achieved.

Furthermore, the location of chilling basin 26 adjacent reservoir 14 creates an efficient arrangement for the piping connecting these components. The cost of installing the cooling system is thereby reduced and operating costs are minimized by the energy efficiency of the reduction in piping. The arrangement of chilling basin 26 and reservoir 14 in a single housing reduces the "footprint" of the system and allows it to be installed in a relatively small area. For larger applications with more than one air washer, the smaller "footprint" eliminates the need for a centralized system with one chilling basin serving several air washers and allows a separate chilling basin to be located with and adjacent to each air washer. Each air washer and chilling basin can therefore be controlled to cool air to the temperature needed at the particular location they serve, while a centralized system does not have this degree of flexibility and control. These benefits are realized even if the bubbler tubes of the present invention are not included.

Laboratory tests conducted on a prototype of the present invention indicate that in a heat exchanger with a water flow of approximately 272 gallons per minute and water speed of 1 foot per second, the use of the bubblers of the present invention increases cooling capacity by approximately 30%.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of transferring heat comprising:

circulating a liquid through heat transfer means to alter the temperature of said liquid, said heat transfer means having a heat transfer surface, said liquid flowing over said heat transfer surface;

maintaining said heat transfer surface at a temperature varying from the temperature of said liquid so that heat is transferred therebetween; and discharging gas into said liquid to form a stream of bubbles therein and locating said bubble stream discharge relative to said heat transfer surface so as to cause said stream of bubbles to flow along said heat transfer surface in close proximity thereto, whereby said stream of bubbles improves heat transfer between said heat transfer surface and said liquid and assists in cleaning from said heat transfer surface any foreign matter which may have collected thereon.

2. A heat transfer device comprising:

heat transfer means for altering the temperature of a liquid, said heat transfer means having a heat transfer surface, the temperature of said heat transfer surface varying from the temperature of said liquid; said liquid flowing over said heat transfer surface; and gas discharge means for discharging a stream of gas bubbles into said liquid, said bubble stream discharge located relative to said heat transfer surface so as to cause said stream of bubbles to pass along said heat transfer surface in close proximity thereto, whereby said stream of bubbles improves heat transfer between said heat transfer surface and said liquid and assists in cleaning from said heat transfer surface any foreign matter which may have collected thereon.

3. A heat transfer method as defined in claim 1 wherein said temperature of said heat transfer surface is maintained by circulating a heat exchange fluid in relation to said heat transfer surface, said heat exchange fluid having a temperature varying from the temperature of said liquid.

4. A heat transfer device as defined in claim 2 wherein said heat transfer means includes a heat exchange fluid having a temperature varying from the temperature of said liquid, said heat exchange fluid circulating in relation to said heat transfer surface so as to maintain said heat transfer surface at a temperature varying from the temperature of said liquid.

5. A heat transfer device as defined in claim 2 wherein said gas discharge means includes bubbler means having openings through which gas is discharged to form said bubbles in said liquid.

6. A heat transfer device as defined in claim 5 wherein said gas discharge means includes a gas blower, a manifold into which said blower introduces positive pressure, and connecting pipes communicating with said air manifold and extending to communicate with said bubbler means.

7. A heat transfer device as defined in claim 5 wherein said heat transfer means includes a liquid supply inlet and a liquid discharge outlet, said liquid in said heat transfer means flowing from said inlet to said outlet, said bubbler means immediately upstream of said outlet being spaced a sufficient distance from said outlet so as to substantially eliminate gas bubbles from entering said outlet.

8. A method of cooling and conditioning air, comprising:

moving air along a predetermined flow path;

providing a cooling stage in said flow path of said air, said cooling stage cooling said air by spraying water into said moving air;

circulating water through heat transfer means to chill said water, said heat transfer means having a heat transfer surface over which said water flows;

maintaining said heat transfer surface at a temperature less than the temperature of said water by circulating a heat exchange fluid in relation to said heat transfer surface, said heat exchange fluid having a temperature less than the temperature of said water;

discharging air into said water to form a stream of air bubbles in said water and locating said air stream discharge so as to cause said stream of air bubbles to pass along said heat transfer surface in close proximity thereto, whereby said bubble air stream improves heat transfer between said heat transfer surface and said water and assists in cleaning from said exterior surfaces of said heat transfer surface any foreign matter which may have collected thereon; and circulating said cooled water to said cooling stage for spraying therefrom.

9. A system for cooling and conditioning air, said system comprising:

means for directing air along a predetermined flow path;

air washer means located in said flow path having spray means for spraying water into said moving air;

heat transfer means for chilling water, said heat transfer means having a heat transfer surface over which said water flows, said heat transfer surface having a temperature less than the temperature of said water, said heat transfer means having heat exchange fluid for chilling said heat transfer surface by circulating said heat exchange fluid in relation to said heat transfer surface, said heat exchange fluid itself having a temperature less than the temperature of said water;

air discharge means for discharging a stream of air bubbles in said water, said air stream discharge located so as to cause said stream of air bubbles to pass along said heat transfer surface in close proximity thereto, whereby said stream of air bubbles improves heat transfer between said heat transfer surface and said water and assists in cleaning from said heat transfer surface any foreign matter which may have collected thereon; and circulating means for circulating said chilled water to said air washer spray means for spraying therefrom.

10. A system for cooling and conditioning air as defined in claim 9 wherein said air discharge means includes bubbler means having openings through which air is discharged to form said bubbles in said water.

11. A system for cooling and conditioning air as defined in claim 10 wherein said bubbler means includes an air blower, a manifold into which said blower introduces positive air pressure, and connecting pipes communicating with said manifold and extending to communicate with said bubbler means.

12. A system for cooling and conditioning air as defined in claim 10 wherein said heat transfer surface comprises a plurality of substantially vertical heat transfer panels having a longitudinal extent, said heat transfer panels formed with two substantially planar exterior surfaces disposed in substantially parallel relation to each other and to other said heat transfer panels, and wherein said bubbler means comprises a plurality of bubbler pipes.

13. A system for cooling and conditioning air as defined in claim 12 wherein said bubbler pipes extend in substantially parallel relation to said heat transfer panels, each of said heat transfer panels being located an equal distance from each of the adjacentmost pair of bubbler pipes, whereby at least some of said streams of air bubbles from one bubbler pipe pass along adjacent planar exterior surfaces of two heat transfer panels.

14. A system for cooling and conditioning air as defined in claim 9 wherein said heat transfer means includes a water supply inlet and a water discharge outlet, said water in said heat transfer means flowing from said water inlet to said water outlet, and wherein said heat transfer means further includes barrier wall means disposed so as to cause said water to flow through said heat transfer means along a serpentine path.

15. A system for cooling and conditioning air as defined in claim 10 wherein said heat transfer means includes a water supply inlet and a water discharge outlet, said water in said heat transfer means flowing from said water inlet to said water outlet, and wherein said bubbler means immediately upstream of said outlet is spaced a sufficient distance from said outlet so as to substantially eliminate air bubbles from entering said water outlet.

16. A system for cooling and conditioning air, said system comprising:

means for directing air along a predetermined flow path;

air washer means located in said flow path having spray means for spraying water into said moving air, said air washer spray means including a water spray pipe and collector means for collecting water sprayed from said water spray pipe;

chilling basin means having a water supply inlet and a water discharge outlet, said water in said chilling basin means flowing from said inlet to said outlet, said chilling basin further having barrier wall means disposed so as to cause said water to flow along a serpentine path;

circulating means for circulating said water from said collector means to said chilling basin means;

refrigerating means for mechanically chilling said water in said chilling basin means, said refrigerating means having in said chilling basin means a plurality of substantially vertical evaporator panels having a longitudinal extent, said evaporator panels formed with two substantially planar exterior surfaces and disposed in substantially parallel relation to each other;

air discharge means for discharging streams of air bubbles in said water in said chilling basin means, said air stream discharge located so as to cause said streams of air bubbles to pass along said exterior surfaces of said evaporator panels in close proximity thereto, said air discharge means including a plurality of bubbler tubes having openings through which air is discharged to form said bubbles, an air blower, a manifold into which said blower introduces positive air pressure, and a connecting pipe communicating with said manifold and extending to communicate with said bubbler tubes, said bubbler tubes extending in substantially parallel relation to each other and in substantially parallel relation to said evaporator panels, each of said evaporator panels being located an equal distance from each of the adjacentmost pair of bubbler tubes, whereby at least some of said streams of air bubbles from one bubbler tube pass along adjacent exterior surfaces of two evaporator panels, said bubbler tubes immediately upstream of said water discharge outlet being spaced a sufficient distance from said outlet so as to substantially eliminate air bubbles from entering said outlet; and recirculating means for recirculating said chilled water to said water spray pipe for spraying therefrom.

17. A method of cooling and conditioning air, comprising:

moving air along a predetermined flow path;

providing a cooling stage in said flow path of said air, said cooling stage cooling said air by spraying water into said moving air;

circulating water through heat transfer means to chill said water, said heat transfer means being located adjacent said cooling stage, said heat transfer means having a heat transfer surface over which said water flows;

maintaining said heat transfer surface at a temperature less than the temperature of said water by circulating a heat exchange fluid in relation to said heat transfer surface, said heat exchange fluid having a temperature less than the temperature of said water;

discharging air into said water to form a stream of air bubbles in said water and locating said air stream discharge so as to cause said stream of air bubbles to pass along said heat transfer surface in close proximity thereto, whereby said bubble air stream improves heat transfer between said heat transfer surface and said water and assists in cleaning from said exterior surfaces of said heat transfer surface any foreign matter which may have collected thereon; and circulating said cooled water from said heat transfer means to said adjacently located cooling stage for spraying therefrom.

18. A system for cooling and conditioning air, said system comprising:

means for directing air along a predetermined flow path;

air washer means located in said flow path having spray means for spraying water into said moving air;

heat transfer means for chilling water, said heat transfer means being located adjacent said air washer means, said heat transfer means having a heat transfer surface over which said water flows, said heat transfer surface having a temperature less than the temperature of said water, said heat transfer means having heat exchange fluid for chilling said heat transfer surface by circulating said heat exchange fluid in relation to said heat transfer surface, said heat exchange fluid itself having a temperature less than the temperature of said water;

air discharge means for discharging a stream of air bubbles in said water, said air stream discharge located so as to cause said stream of air bubbles to pass along said heat transfer surface in close proximity thereto, whereby said stream of air bubbles improves heat transfer between said heat transfer surface and said water and assists in cleaning from said heat transfer surface any foreign matter which may have collected thereon; and circulating means for circulating said chilled water from said heat transfer means to said adjacently located air washer spray means for spraying therefrom.

19. A system for cooling and conditioning air, said system comprising:

housing means including means for directing a predetermined quantity of air moving through said housing means along a predetermined flow path;

air washer means located in said housing means and within said predetermined flow path of said moving air, said air washer means having spray means for spraying water into said moving air;

heat transfer means for chilling water, said heat transfer means being located in said housing means adjacent said air washer means and within said predetermined flow path of said moving air, said heat transfer means having a heat transfer surface over which said water flows, said heat transfer surface having a temperature less than the temperature of said water, said heat transfer means having heat exchange fluid for chilling said heat transfer surface by circulating in relation to said heat transfer surface, said heat exchange fluid itself having a temperature less than the temperature of said water; and circulating means associated with said housing means for circulating said chilled water from said heat transfer means to said adjacently located air washer spray means for spraying therefrom.

* * * * *